US006334259B1

(12) United States Patent
Harvey

(10) Patent No.: US 6,334,259 B1
(45) Date of Patent: Jan. 1, 2002

(54) SCORING TOOL FOR SIDING MATERIAL AND METHOD OF USE

(76) Inventor: Barry Harvey, Box 548, Breton, Alberta (CA), T0C 0P0

( * ) Notice: Subject to any disclaimer, the term of this patent is extended or adjusted under 35 U.S.C. 154(b) by 0 days.

(21) Appl. No.: 09/593,700

(22) Filed: Jun. 15, 2000

(30) Foreign Application Priority Data

Apr. 5, 2000 (CA) ..... 2304051

(51) Int. Cl.[7] ..... B26B 29/00; B43L 13/02
(52) U.S. Cl. ..... 33/42; 33/411
(58) Field of Search ..... 33/42, 32.3, 32.2, 33/33, 41.1, 41.3, 41.6, 411

(56) References Cited

U.S. PATENT DOCUMENTS

| | | | | | |
|---|---|---|---|---|---|
| 750,221 | A | * | 1/1904 | Reis | 33/42 |
| 1,100,878 | A | * | 6/1914 | Higgins et al. | 33/32.2 |
| 1,945,730 | A | * | 2/1934 | Christman | 33/41.6 |
| 4,030,195 | A | | 6/1977 | Insolio | |
| 4,122,791 | A | | 10/1978 | Brown | |
| 4,903,409 | A | * | 2/1990 | Kaplan et al. | 33/42 |
| 5,103,566 | A | * | 4/1992 | Stebe | 33/42 |
| 5,197,195 | A | * | 3/1993 | Aikens | 33/42 |
| 5,203,090 | A | * | 4/1993 | Bouska et al. | 33/42 |
| 5,309,642 | A | * | 5/1994 | McGinnis | 33/42 |
| 5,421,093 | A | | 6/1995 | Davidson, Jr. | |

OTHER PUBLICATIONS

"The Sider", Malco Products, Advertisment, Jan. 1997.

* cited by examiner

*Primary Examiner*—Christopher W. Fulton
(74) *Attorney, Agent, or Firm*—Sean W. Goodwin

(57) ABSTRACT

A single tool is provided to score the surface of aluminum or vinyl siding regardless of profile. The tool comprises an extensible measuring rail at the end of which is attached a scoring knife attached, the rail and knife being extensible from a siding guide which interlocks solely with the edge of the siding material. The measuring rail is spaced above the guide for spacing the rail and scoring blade above the surface of the siding material, thus avoiding undesirable damage to the surface as it is engaged in the tool and as the tool is drawn down the edge of the siding during scoring. The scoring knife is pivotable on the measuring rail so as to contact with the siding surface when under control of the installer and regardless of the siding profile. Further the knife is reversible for use by both right and left-handed installers.

15 Claims, 7 Drawing Sheets

47
43
41
46
43
32
42
45
44
40

SCORING TOOL FOR SIDING MATERIAL AND METHOD OF USE

FIELD OF THE INVENTION

The present invention relates to apparatus and method for measuring and scoring of materials, more particularly to scoring aluminum and vinyl siding.

BACKGROUND OF THE INVENTION

A myriad of tools are available for the purpose of measuring and scoring different materials. The variety of designs results from the unique properties or requirements of the material to be scored.

Conventional siding materials used to clad the exterior walls of residential and commercial buildings are usually made of extruded aluminum or vinyl and are available in a number of standard profiles. Typically, the profiles mimic that of clapboard siding. Rather than siding by overlapping board by board, as clapboard is installed, the siding is extruded in strips or panels that mimic one or more pieces of board on one strip. The width of the "boards" on the extruded siding, their shape and the way in which they appear to overlap dictates the profile of the siding. There are a number of different profiles available, some of which are standard double 4", standard double 5" or 4.5" and Dutch lap or cove.

The strips are installed on the supporting structure in an interlocking manner, starting at the bottom of the wall, by nailing across the length of a nailing strip at the top of the extruded strip, through holes formed in the nailing strip. Each upper adjacent strip is interlocked to the one below, usually by interlocking a U-shaped catch at the bottom of the upper strip with a flange below the nailing strip of the lower piece of siding. In this manner the nailing strip is hidden from view, creating a continuous clapboard appearance.

As structural walls vary in height and openings may be placed at unique positions in the walls, the uppermost strip will have to be cut longitudinally to fit below the eave of the roof, and other strips cut above door openings and above and below window openings. While vertical cuts are easily made into the siding strips using metal snips, longitudinal cuts present greater challenges.

Longitudinal cuts in aluminum siding strips are generally made by first measuring and marking the strip with a pencil and then scoring the siding with a utility knife. Aluminum siding can then be bent back and forth along the score line until it snaps. Most utility knives have relatively thin blades, often designed to be snapped off at regular intervals in order to keep the blade sharp. These blades are flimsey, which makes it difficult to apply enough pressure to the knife to score without wandering over the surface of the siding material. This is especially true if the siding is to be cut on the sloping portion of the siding profile. This requires skill and steadiness of hand when using an unsupported utility knife.

A prior art scoring tool that utilizes a plastic plate specific for the profile of siding is known. It is essential to have a different plate for each profile of siding used as the plate utilizes the unique features of the siding profile, such as the horizontal shoulders, as a support and guide. A thumb screw with a scoring tip is screwed into one of a plurality of holes bored through the plate, to correspond with the desired measurement of the score line on the siding. Pressure is applied to the plate and the thumbscrew as it is moved along the surface of the siding, guided by the bottom edge of the siding and the horizontal shoulders of the profile. It is essential that the scoring tip be aligned in the direction of the score at all times or it will wander and not cut.

It is also essential that pressure be applied downward and laterally to keep the plate aligned along the edge and shoulder, as the scoring tool does not interlock with the siding in any way. Further, any small pieces of debris on the surface of the siding will be dragged below the plate and result in scratching, which is especially visible on aluminum siding.

Alternatively, both aluminum and vinyl siding can be cut along the marked line using tin snips, aviation snips or a circular saw, either hand held or mounted. Hand held metal snips are difficult to use when making longitudinal cuts, especially the full length of the siding strip, as the installer has little room for his hand between the cut pieces and the cut material is stiff. Offset handles have improved this situation, however, cutting the amount of siding required to top all four walls of a structure as well as openings for windows and doors requires very strong hands.

The use of a circular saw requires a more complex set-up on the job-site as the siding strip must be supported by a solid structure in order to run it the full length of the strip along the scribed line. If the saw is mounted, the installer must be able to support and pass the siding strip through the saw blade.

Clearly there is a need for a simple reliable scoring tool that requires little job-site setup, is easily used by an installer, requires little effort to maintain alignment and will not damage the surface of the siding during use. Ideally a single tool would be used for all available siding profiles

SUMMARY OF THE INVENTION

A tool for accurately scoring siding material is provided comprising a measuring rail, to which a scoring blade is pivotally mounted at its distal end, which is extensible from a hounding mounted on a guide for engaging the end of the U-shaped catch at the bottom edge of a siding strip. The scoring tool is slidable along the edge of the siding material once it is interlocked with the U-shaped catch at the bottom edge of the material. The measuring rail housing is mounted on the guide so as to create a unique alignment block which spaces the measuring rail and scoring knife above the surface of the siding material, preventing damage to the surface of the siding material. Means are provided for locking the measuring rail at an extended position.

Preferably, the housing is mounted pivotally to the guide to create extra space for engaging siding with different profile heights and allow the scoring knife blade to be pivoted to contact the siding surface at any position on the siding profile. The scoring tool guide can be interlocked with the siding material from either end of the U-shaped channel in the guide, the channel sized to allow limited rotation of the U-shaped catch at the edge of the siding material.

Preferably the scoring knife comprises a blade portion and a handle portion, the blade being carbide tipped, such as used for cutting plastic laminate and can be pivotably and reversibly mounted on the end of the measuring rail for use by either right handed or left handed installers.

A method of scoring siding material at a desired measurement is described comprising the steps of providing a scoring tool comprising a measuring rail to which a scoring blade is pivotally mounted and which is extensible from a guide which engages the end of a U-shaped catch at the bottom edge of siding material and is slidable thereon, the guide spacing the measuring rail above the surface of the siding material;

extending the measuring rail to the desired measurement;

interlocking the guide with the U-shaped catch at the bottom edge of the siding material rotating the scoring knife to position the scoring blade in contact with the siding material; and drawing the scoring tool along the siding material while applying pressure to the scoring knife.

Thus, a single scoring tool is provided that can be used on any profile of siding material as the scoring tool interlocks and co-operates solely with the edge of the siding material. The surface of the siding material is protected from damage by the tool as the measuring rail is spaced above the surface of the material and the scoring knife is pivotable to a non-actuated position wherein the blade is away from the material surface.

DETAILED DESCRIPTION OF THE PREFERRED EMBODIMENT

Figure 1:
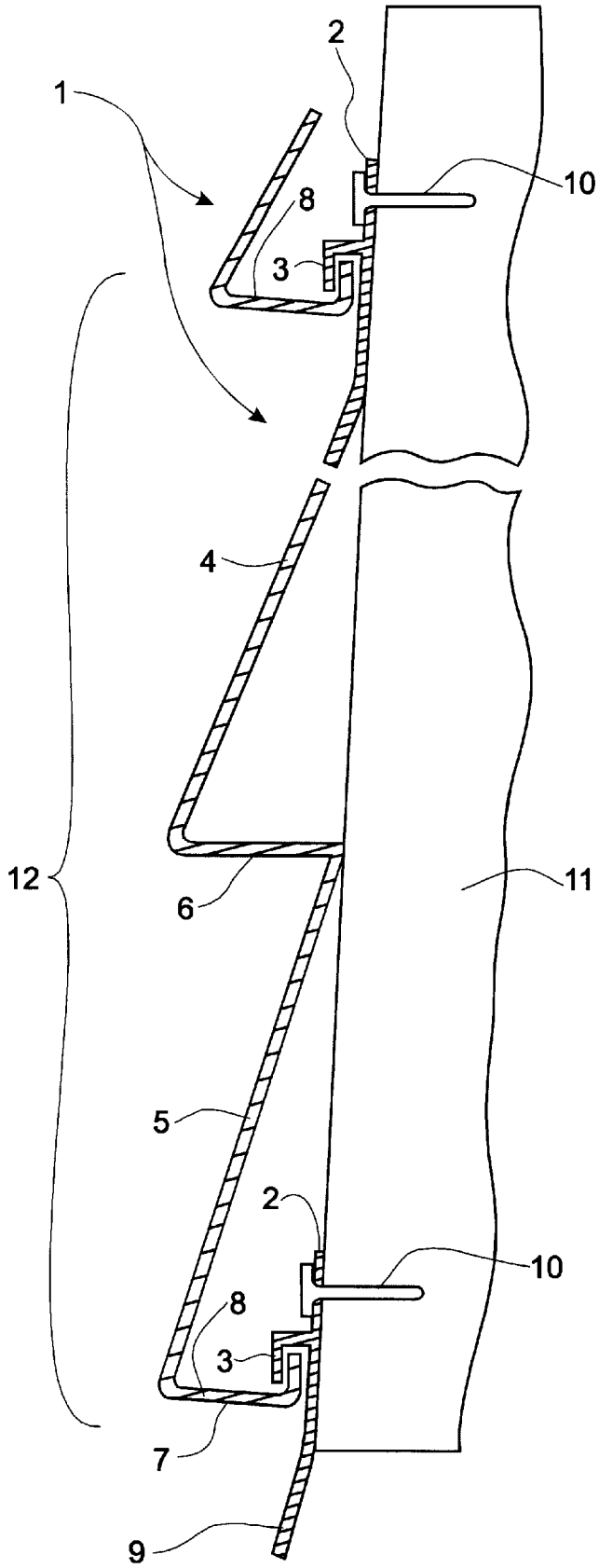
FIG. 1 is a side view of one profile of conventional siding attached to a supporting structure, showing a U-shaped catch at the bottom of a siding strip interlocked with a flange extending outward and downward formed below the nailing strip of a lower siding strip.

Conventional siding material 1, such as double cove siding as shown in FIG. 1, comprises a nailing strip 2, a flange member 3, upper 4 and lower 5 declinations being somewhat planar and extending downwardly and slightly outwardly from the nailing strip 2, upper 6 and lower 7 shoulders extending inwardly and substantially horizontally from the lower edges of the upper 3 and lower 4 declinations and a U-shaped catch 8 formed at the lower shoulder 7. The shape and degree of slope on the declinations 4,5, the angle of the horizontal shoulders 6,7 and the depth of the declinations 4,5 are variable depending upon the desired appearance or profile of the siding.

With reference again to FIG. 1, a first strip 9 of siding material 1 is secured by nails 10 to the lower edge of the supporting wall 11 through holes in the nailing strip 2. A second strip 12 of siding material 1 is interlocked to the first attached piece of siding 9 by snapping its U-shaped catch 8 over the downwardly extending flange 3 of the first siding strip 9. The second siding strip 12 is then nailed 10 to the supporting structure 11 and the process repeated over and over until the entire wall surface is covered.

Figure 2:
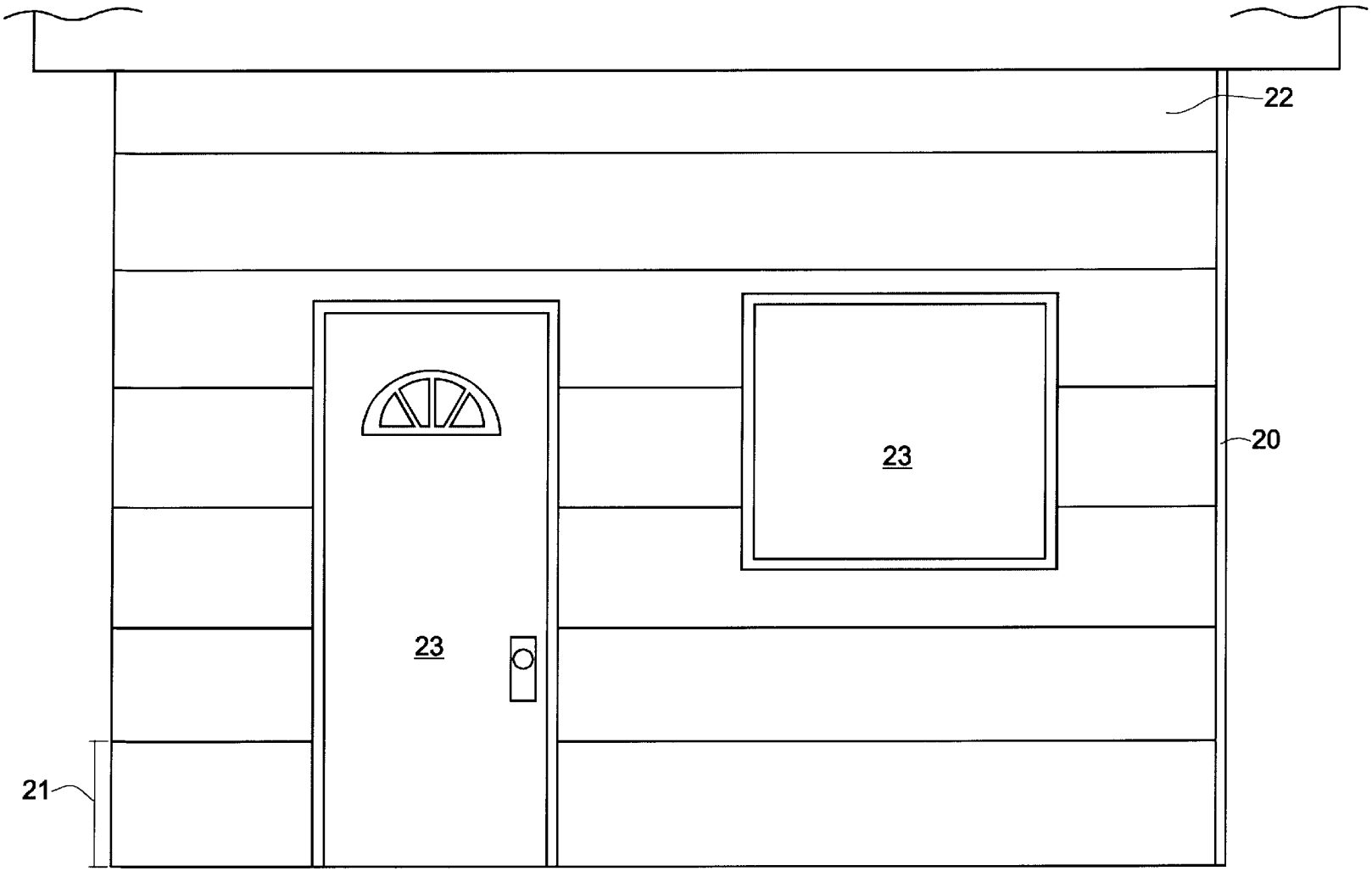
FIG. 2 is a schematic of a wall clad in siding material, illustrating the need for longitudinal cutting of siding strips at the tops of walls and under and over openings in the structure.

As shown in FIG. 2, a wall's height 20 is clad with siding strips of a specific height 21. The height of the final piece of siding material 22 must be cut, shortening it to fit the top of the wall. Similarly, if there is an opening in the wall 23, the siding must be cut to fit above and below the opening to maintain a continuous clapboard appearance. Further, it is clear that the siding may require cutting across any portion of its profile, on the sloped declinations, at the apex of the shoulder, or on the flattened portions near the nailing strips.

Figure 3:
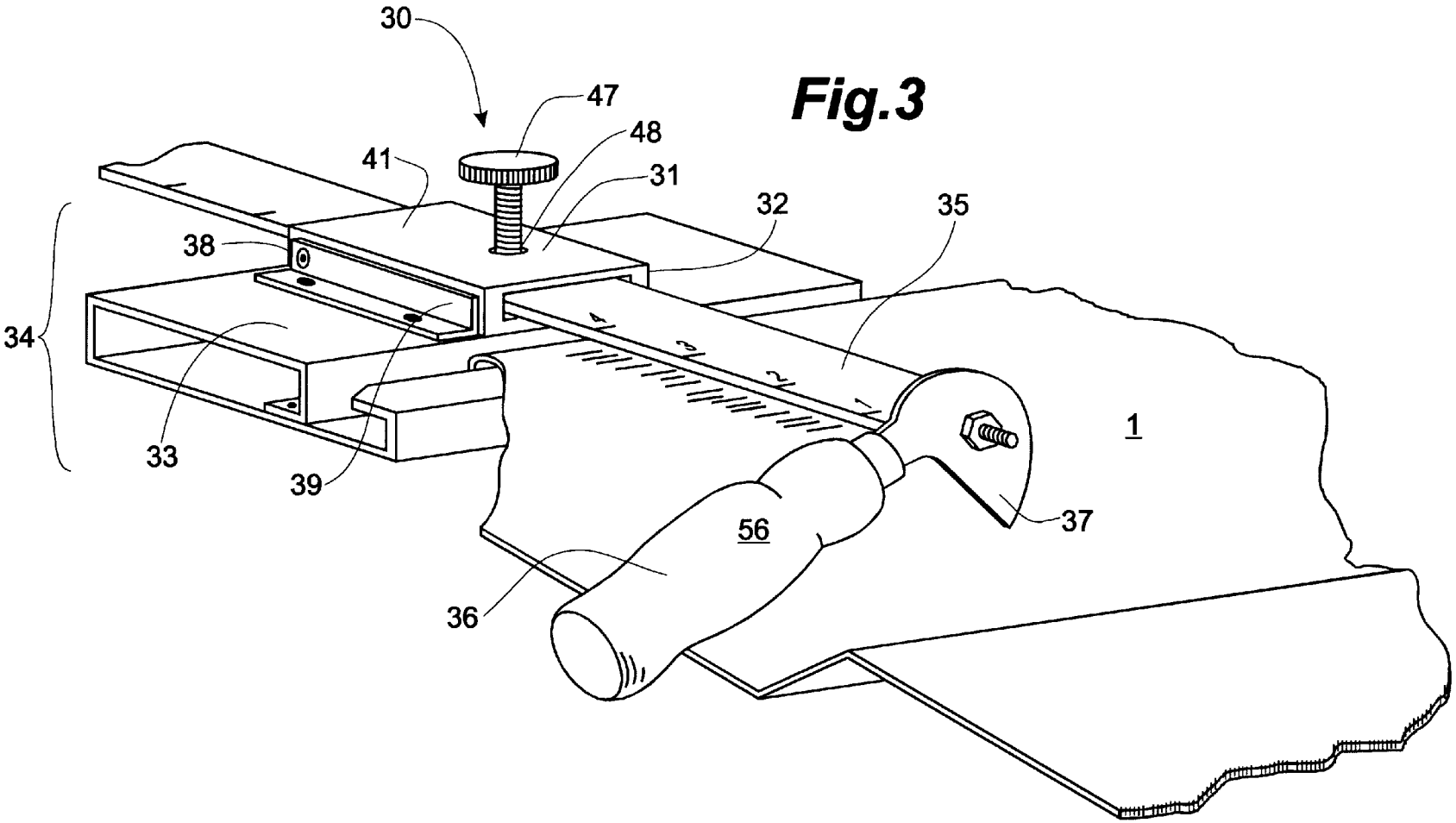
FIG. 3 is a perspective view of the scoring tool of the present invention showing a partial piece of siding interlocked in the housing guide.
Figure 4:
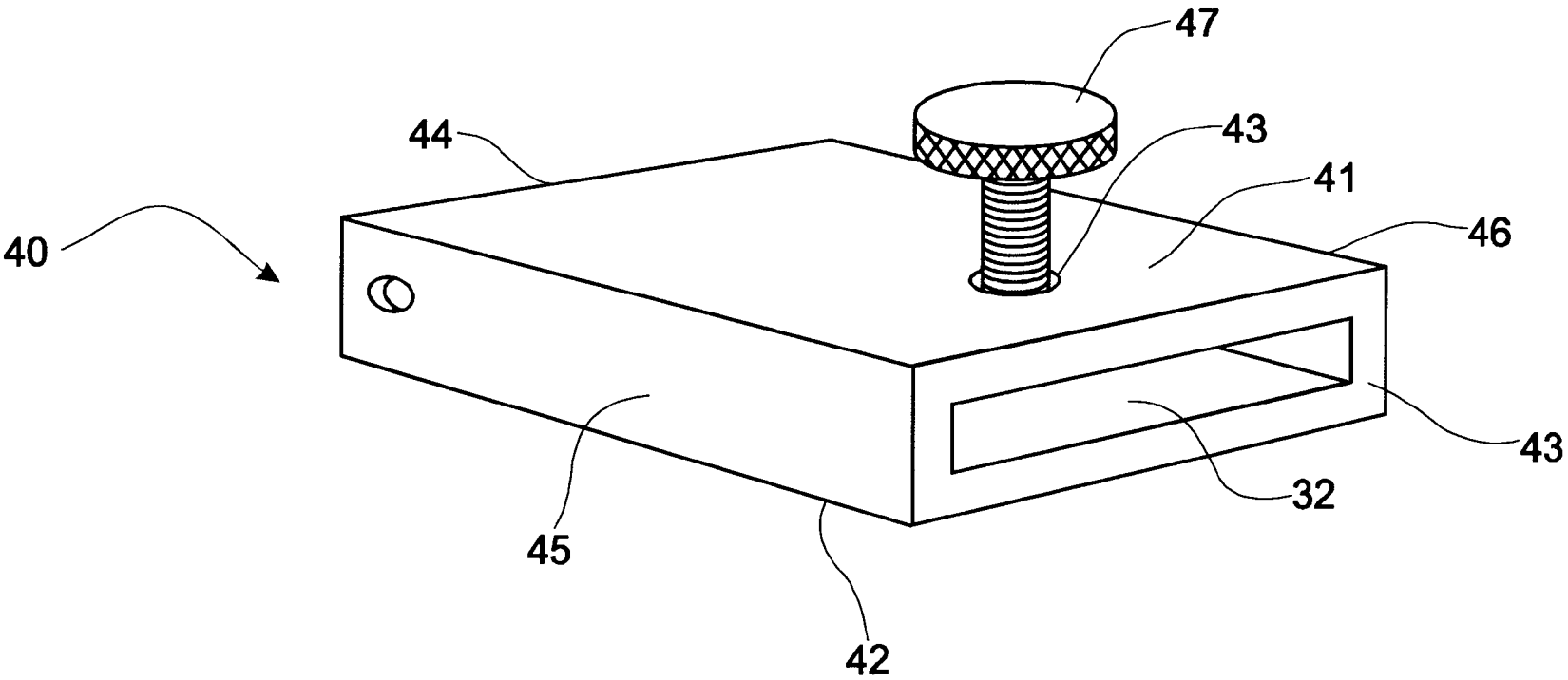
FIG. 4 is a perspective view of the housing of the scoring tool showing the orientation of the slot.
Figure 5:
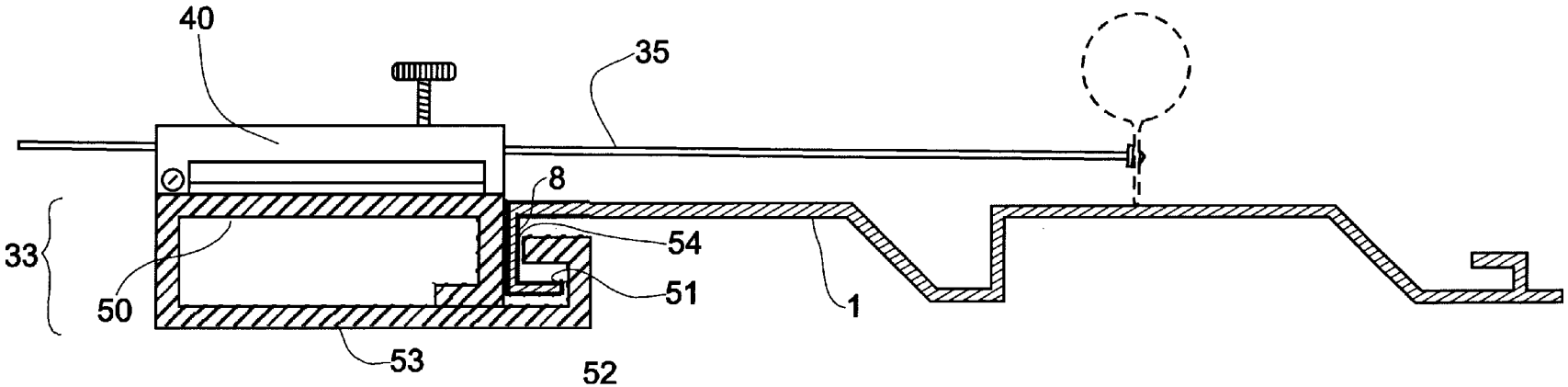
FIG. 5 is a side view of the scoring tool of the present invention with a piece of siding material interlocked in the housing guide.

Having reference to FIGS. 3–5, a scoring tool 30 to make longitudinal cuts in aluminum and vinyl siding material 1, is provided. The scoring tool 30 comprises a housing 31 having a slot 32 and a siding guide 33 co-operating to form an alignment block 34, a slidably extending rigid measuring rail 35, and a scoring knife 36.

Having reference to FIGS. 3,4, the housing 31 comprises a rectangular block 40 having a top surface 41, a bottom surface 42, a front side 43, a back side 44 and identical left and right sides 45,46. A rectangular slot 32, sized to allow the measuring rail 35 to pass therethrough, is disposed centrally through the housing 31, extending from the front side 43 through to the back side 44.

The measuring rail 35 comprises a rigid rectangular member inscribed in distance increments, preferably both metric and imperial. The measuring rail 35 is slidable within the rectangular slot 32 in the housing 31 and when positioned in the housing 31 extends parallel to the housing axis.

A thumb screw 47, inserted through a threaded hole 48 in the top surface 41 of the housing 31, extends into the slot 32 and when screwed into the hole 48 applies pressure to the measuring rail 35 prevent it from sliding further into or out of the slot 32. This allows a fixed measurement to be set.

Having reference to FIG. 5, the siding guide 33 has a main body 50 formed with a U-shaped channel 51 along a front edge. The U-shaped channel 51 is formed as an outward extension from the base 53 of the main body 50, extending outward, upward and then back inwards again towards the front edge of the main body 52 of the guide 33. A space 54 is formed between the channel 51 and the front edge of the guide 52, sufficient in size to accommodate the base of the U-shaped catch 8 at the bottom of the siding strip 1. The space 54 does not permit the siding catch 8 to leave the channel 51 unless the guide 33 is slid longitudinally off the end of the siding strip 1. The U-shaped channel 51 is of sufficient space to allow some rotation of the siding material 1 within the channel 51, which aids in positioning the siding 1 within the guide 33. The channel 51 in the guide 33 thus co-operates with the U-shaped catch 8 at the bottom of the siding strip 1 to maintain secure alignment of the guide 33 with the edge of the siding material 1.

The housing 31 is mounted to the top surface 41 of the siding guide 33 in such as way as to have the measuring rail 35 extend perpendicular to the axis of the siding guide 33 and the siding material 1. The housing slot 32 is spaced sufficiently above the siding material 1 so as to allow room to interlock the siding material 1 in the guide 33 without contacting the scoring knife 36. Further, the measuring rail 35 is also spaced above the siding 1 so that when the scoring tool 36 is drawn along the edge of the siding 1, only the blade 37 of the, scoring knife 36 in the actuated position contacts the surface of the siding 1. In this way the surface is protected from scratching.

Optionally, the housing 31 can be mounted pivotally to the siding guide 33 at a pivot point 38, located adjacent the back side 44 of the housing 31. If mounted pivotally, the housing 31 can be pivoted upward relative to the guide 33 and create even more space between the measuring rail 35 and the knife blade 37 and the siding surface 1. Thus siding of different profile heights can easily be interlocked in the guide 33 while avoiding contact with the measuring rail 35 or the scoring blade 37.

Further, the housing 31 can be laterally supported by pieces of angle material 39, attached to the top surface of the guide 33, on either side 45,46 of the housing 31. These angled supports 39 limit lateral movement of the housing 31 relative to the guide alignment block 34 as lateral pressure is applied to the scoring tool 30 to draw it down the edge of the siding material 1.

Figure 6:
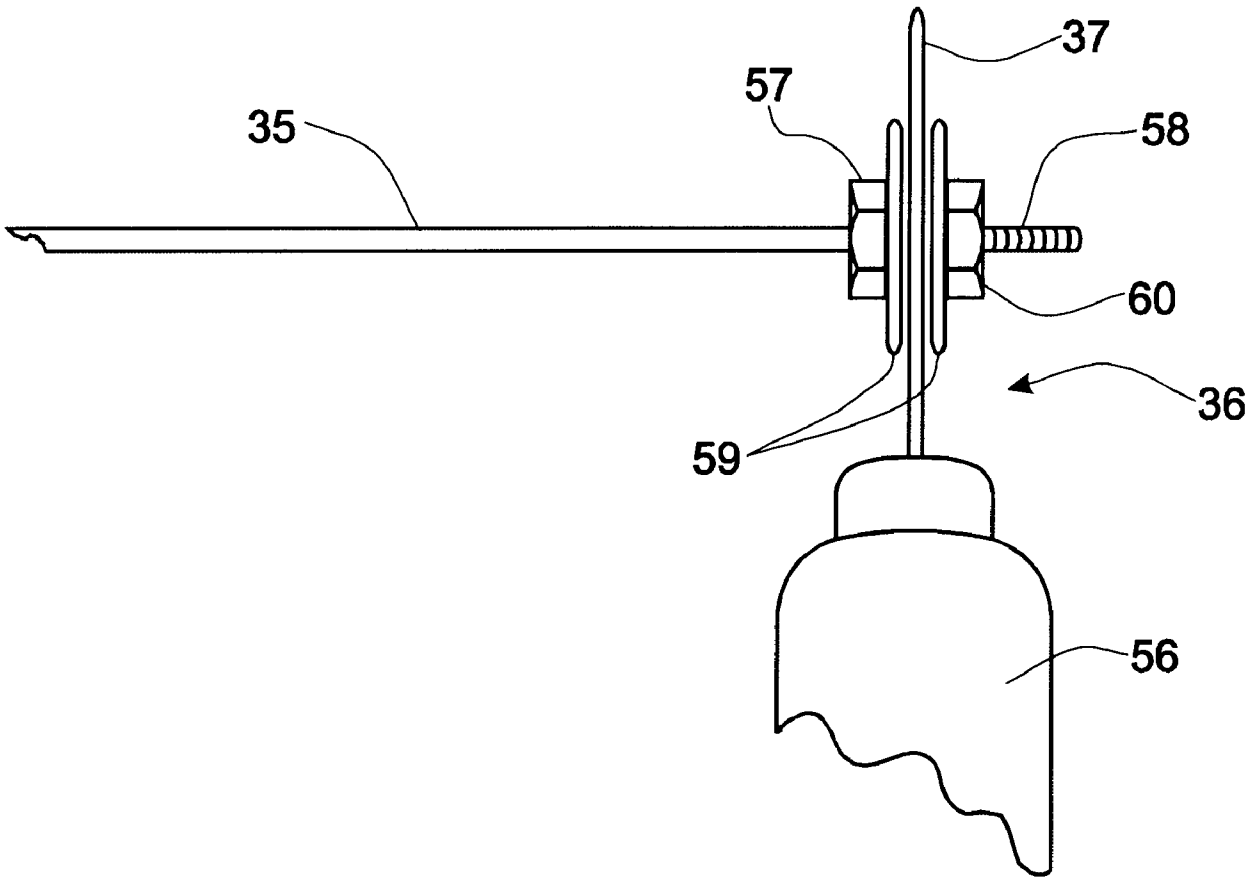
FIG. 6 is a side view of the end of the measuring rail showing the pivotal attachment of the scoring knife.
Figure 7A:
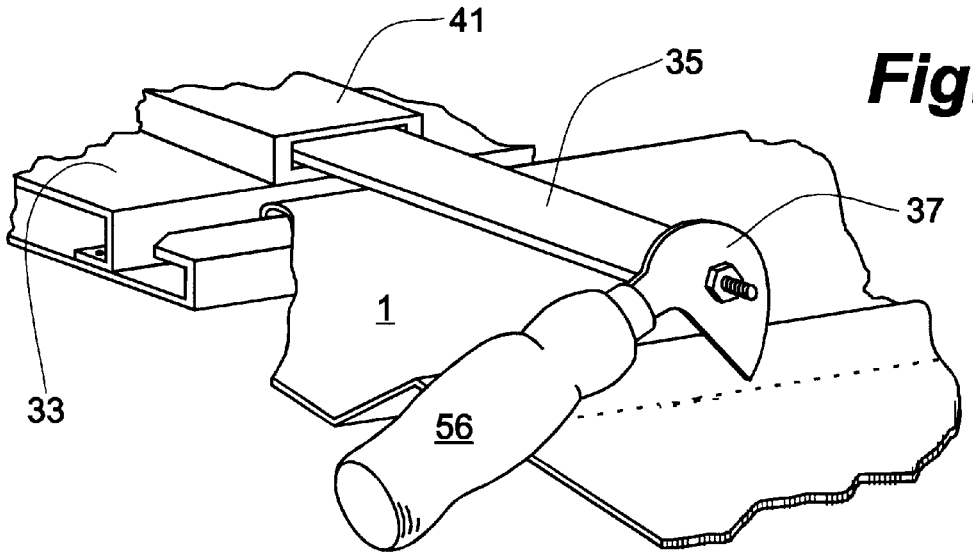
FIG. 7*a* is a perspective view of the scoring knife of the present invention showing the knife blade in an actuated position relative to a higher point on the siding profile.
Figure 7B:
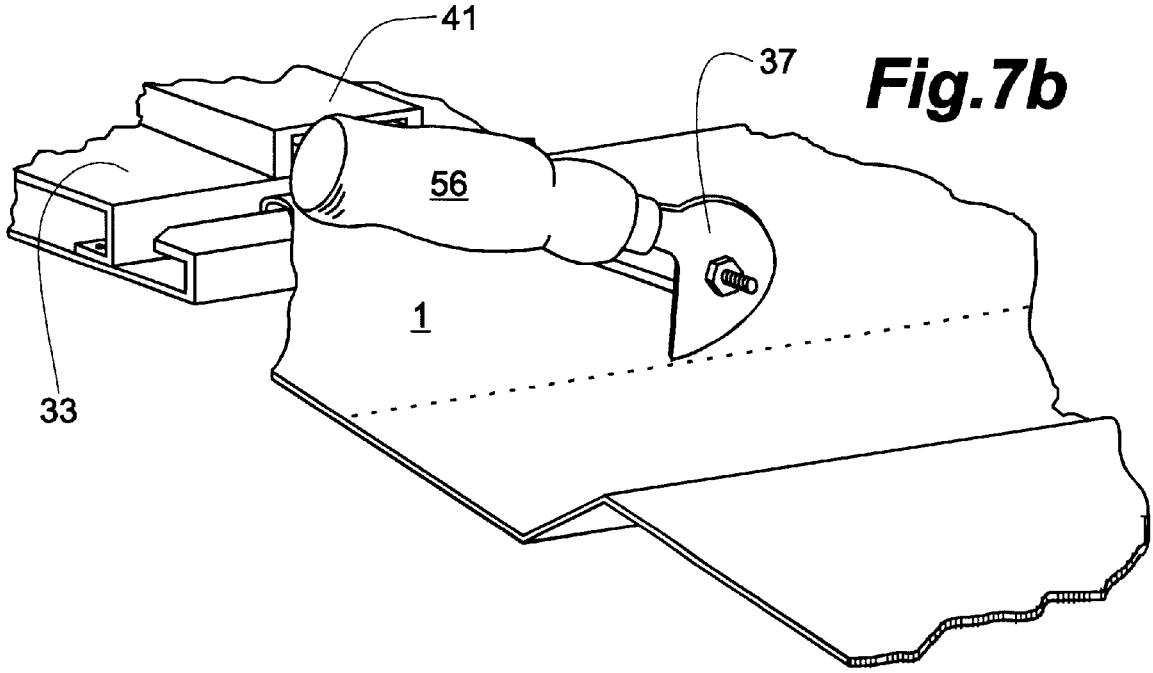
FIG. 7*b* is a perspective view of the scoring knife of the present invention showing the knife blade in an actuated position relative to a lower point on the siding profile.

As shown in FIG. 6, the scoring knife 36 having a blade 37 and a handle 56 is mounted pivotally at a first end 57 of the measuring rail 35. The knife blade 37 is spaced from the end of the measuring rail 35 so as to be at a "zero" increment position relative to the increments on the rail 35. This allows accurate measurements to be made with the measuring rail 35. Pivotally attached, the knife 36 can be rotated in an arcuate path from a non-actuated position wherein the blade 37 is rotated upward away from the surface to be scored, to an actuated position, shown in FIGS. *7a*, *7b*, wherein the blade 37 is rotated downward onto the surface to be scored. The handle 56, allows the user to apply pressure to the blade 37, allows the blade to be lowered to deeper positions on the siding material's profile and provides a means to draw the scoring tool 30 along the surface of the siding 1.

Preferably, the scoring knife 36 has a stiff, carbide tipped blade 37 such as used to cut plastic laminate or arborite.

Preferably, the scoring knife 36 is mounted to the measuring rail 35 using a threaded bolt 58 welded to the end of the measuring rail 35. Washers 59 sandwich the scoring knife 37 and a removable nut 60 secures the scoring knife 36 to be mounted on the measuring rail 35, The bolt and nut allow the knife 36 to be mounted reversibly for use by either left handed or right handed installers.

IN USE

After determining where the siding material 1 is to be scored, the thumbscrew 47 in the top of the housing 31 is loosened and the measuring rail 35 adjusted to the desired increment. The thumbscrew 47 is then tightened to prevent any further movement of the measuring rail 35 within the housing 31. The scoring knife 36 is pivoted so that the blade 37 is in the non-actuated position to prevent contact with the siding material 1 as it is engaged with the siding guide 33 of the alignment block 34.

The siding material 1 is interlocked in the guide 33 by sliding the U-shaped catch 8 at the bottom edge of the siding into the U-shaped channel 51 in the siding guide 33, starting at the edge of the siding material 1.

If the siding material 1 is to be scored its full length, the scoring knife 36 is immediately pivoted to the actuated position and the installer draws the scoring blade 37 towards the opposite end of the siding strip 1 using the knife handle 56. The U-shaped catch 8 and channel 51 co-operate to hold the guide and knife in precise alignment with the desired scoring position. If only a portion of the siding material 1 is to be cut longitudinally, the installer slides the scoring tool 30 to the desired spot on the siding 1, pivots the knife blade 37 to the actuated position and scores the material 1 as described above. He then pivots the knife blade 37 back to the non-actuated position and slides the scoring tool 30 off the edge of the siding material 1. Perpendicular cuts from the edge of the siding material 1 to the scored line are then be made using handheld tin snips and the cut portion of the siding strip 1 removed.

The embodiments of the invention in which an exclusive property of privilege is being claimed are detailed as follows:

1. A tool for accurately scoring siding material having an extensible measuring rail to which a scoring blade is pivotally mounted at its distal end and an improved alignment block comprising:

a U-shaped channel for engaging the end of the U-shaped catch at the bottom edge of a siding strip, and being slidable therealong;

a housing for the measuring rail, attached pivotally to the guide so as to space the measuring rail and scoring knife above the surface of the siding material; and means for locking the measuring rail at an extended position.

2. A siding scoring tool as described in claim 1 wherein the siding guide channel is accessible bi-directionally.

3. A siding scoring tool as described in claim 2 wherein the siding guide channel is sized to allow limited rotation of the U-shaped catch of the siding material within the channel.

4. A siding scoring tool as described in claim 3 wherein the scoring blade is a scoring knife comprising a blade and handle.

5. A siding scoring tool as described in claim 4 wherein the scoring knife is a plastic laminate cutter.

6. A siding scoring tool as described in claim 5 wherein the scoring knife can be reversibly mounted for use by a right or left handed installer.

7. A siding scoring tool as described in claim 6 wherein the means to lock the measuring rail in an extended position is a thumbscrew.

8. An improved siding tool for accurately scoring siding, the siding having a U-shaped catch along a bottom edge, the tool having a alignment block with an extensible measuring rail to which a siding scoring knife is mounted at a distal end, the improved tool comprising:

a guide which engages and slides along the siding's bottom edge, the guide having a base and a top;

a U-shaped channel extending outwardly from the guide's base and returning inwardly towards the guide for interlocking with the siding's U-shaped catch and retaining the guide to the siding while enabling the guide to slide therealong; and a housing at the top of the guide for supporting and spacing the extensible measuring rail and scoring knife above the surface of the siding.

9. The improved siding tool of claim 8 wherein the U-shaped channel is sized sufficiently to allow limited rotation of the U-shaped catch therein.

10. The improved siding tool of claim 9 wherein the housing is pivotally mounted to the guide for variable spacing of the extensible measuring rail and scoring knife above the siding.

11. The improved siding tool of claim 10 wherein the scoring knife comprises a blade and handle, the blade being which is pivotally mounted to the extensible measuring rail.

12. The improved siding tool of claim 11 wherein the blade and handle can be reversibly mounted for use by a right or left handed installer.

13. The improved siding tool of claim 12 wherein the measuring rail is positioned and locked at an extending position using a thumbscrew.

14. A method of scoring siding comprising:

providing a scoring tool comprising a guide having an extensible measuring rail and a scoring blade mounted at a distal end of the rail, the guide slidable along a bottom edge of the siding and having a base from which a U-shaped channel extends outwardly and returns inwardly for engaging and interlocking with a U-shaped catch formed along the siding's bottom edge, the guide spacing the measuring rail above the surface of the siding material;

extending the measuring rail to the desired measurement;

interlocking the guide's U-shaped channel and the siding's U-shaped catch;

contacting the scoring blade with the siding; and drawing the scoring blade along the siding wherein the interlocking U-shaped channel and U-shaped catch co-operate to accurately retain the blade and score the siding at the desired measurement.

15. The method of scoring siding of claim 14 further comprising pivoting the measuring rail from the guide to further space the measuring rail from the siding during interlocking.

* * * * *